United States Patent [19]

Glass

[11] Patent Number: 4,534,110

[45] Date of Patent: Aug. 13, 1985

[54] TRIPLE-EDGE SAFETY RAZOR AND BLADE

[75] Inventor: Henry P. Glass, Northfield, Ill.

[73] Assignee: David Mall, Chicago, Ill.

[21] Appl. No.: 453,838

[22] Filed: Dec. 28, 1982

[51] Int. Cl.[3] ..... B26B 21/20

[52] U.S. Cl. ..... 30/346.57; 30/50; 30/85; 30/346.58

[58] Field of Search ..... 30/346.57, 346.58, 346.52, 30/346.59, 85, 50

[56] References Cited

U.S. PATENT DOCUMENTS

| | | | |
|---|---|---|---|
| 1,573,244 | 2/1926 | Hickey | 30/346.57 |
| 1,840,199 | 1/1932 | Hoff | 30/346.57 |
| 1,872,721 | 8/1932 | Ford | 30/346.57 |
| 1,938,477 | 1/1933 | Apostoll | 30/346.57 |
| 1,988,167 | 1/1935 | DeBats | 30/346.58 |
| 2,019,475 | 11/1935 | Baudis | 30/346.57 |
| 2,352,785 | 7/1944 | Gustafson | 30/346.58 X |
| 2,361,216 | 10/1944 | Lewando | 30/346.58 X |
| 2,582,913 | 1/1952 | Pfefferle | 30/346.59 |

FOREIGN PATENT DOCUMENTS

| | | | |
|---|---|---|---|
| 9905 | of 1909 | United Kingdom | 30/346.59 |

*Primary Examiner*—Jimmy C. Peters

*Attorney, Agent, or Firm*—Dressler, Goldsmith, Shore, Sutker & Milnamow, Ltd.

[57] ABSTRACT

A triple-edge safety razor in which no portions thereof are disconnected during use. The razor employs a novel blade assembly wherein three individual strip blades are interconnected by a flexible central web affording hinged connections therebetween. A number of methods of manufacture of the blade assembly are described.

5 Claims, 7 Drawing Figures

TRIPLE-EDGE SAFETY RAZOR AND BLADE

FIELD OF THE INVENTION

This invention relates to safety razors and more particularly to a quick-change razor having more than the conventional two shaving edges and a novel blade for use in the razor.

BACKGROUND OF THE INVENTION

The quest for the perfect shaving razor is as old as shaving itself and has merely intensified with the introduction of safety razors. In addition to having sharp and smooth cutting edges, such a razor must use blades that are relatively long lived and give many comfortable shaves. The blades must be relatively inexpensive and changing and rinsing of the blade during use must be quick, convenient and trouble free. Every user has his or her own preference, but it is unlikely that any prior art or conventional razor approaches the ideal for all of the desired characteristics alluded to.

Representative examples of prior efforts at providing improved safety razors may be seen in U.S. Pat. Nos. 949,255 and 2,973,575. The earlier patent teaches a razor having resiliently mounted lugs adapted to retain a double-edge blade at its corners and a handle with spring-urged means for releasing or engaging the blade. In that patented structure, the blade was undesirably uncovered and exposed and the maintenance of the necessary tension on modern thin-metal blades questionable.

In the later of those prior patents, there is shown a razor having the familiar and bothersome two-piece construction which includes a separate clamping head. Problems of cost and difficulty of manufacture of the generally triangular double-edge blade were also presented because conventional straight edge, continuous strip manufacturing techniques were precluded.

Other efforts in this art have included razors for double-edge blades of unified construction and screw-type handles for opening and closing the clamping top, injector-type mechanisms for use with single-edge blades and, more recently, replaceable cartridges containing one or two single-edge blades. As every daily user of razors can attest, each of those prior expedients has certain undesirable as well as desirable features.

Yet another approach to the improved safety razor is illustrated in U.S. Pat. No. 2,863,213. That patent teaches a three piece, separable, razor structure and a trapezoidal blade having four edges for enhanced shaving life. Once again, the form of the patented blade was complex and precluded the employment of modern and efficient continuous strip manufacturing methods.

Thus, there still exists the need for a safety razor which better combines the desirable aims of convenience, durability, long blade life and reasonable blade cost.

SUMMARY OF THE INVENTION

The present invention eliminates or reduces substantially the disadvantageous features inherent in prior safety razors by providing a razor with three or more shaving edges. A greater number of shaves and longer useful life for each blade is thereby achieved.

Despite the fact that it has more than two shaving edges, e.g., three, the blade of the invention may nonetheless be fabricated utilizing conventional continuous strip, mass production methods. In this respect, the blade of the invention may be said to be a compound blade comprising three or more separate blades, made by conventional methods, connected together to provide unitary multi-edge blade. The multiple separate blades are unified by a flexible web shaped to act as hinged connections. A number of different manufacturing methods are suggested for interconnecting the separate blades with the web.

The razor itself comprises a unified structure having a handle and a clamping head, which for a three sided blade is triangular. During normal use, the clamping head is always attached to and does not become separated from the handle. With a simple one finger manipulation, the clamping head may be raised from the handle to permit insertion, removal or rinsing of a blade.

Other features and advantages of the invention will be apparent from the following description and claims and are illustrated in the acompanying drawings which show structure embodying preferred features of the present invention and the principles thereof.

DETAILED DESCRIPTION OF THE INVENTION

Figures 1, 2, 3, 4, 5, 6, 7:
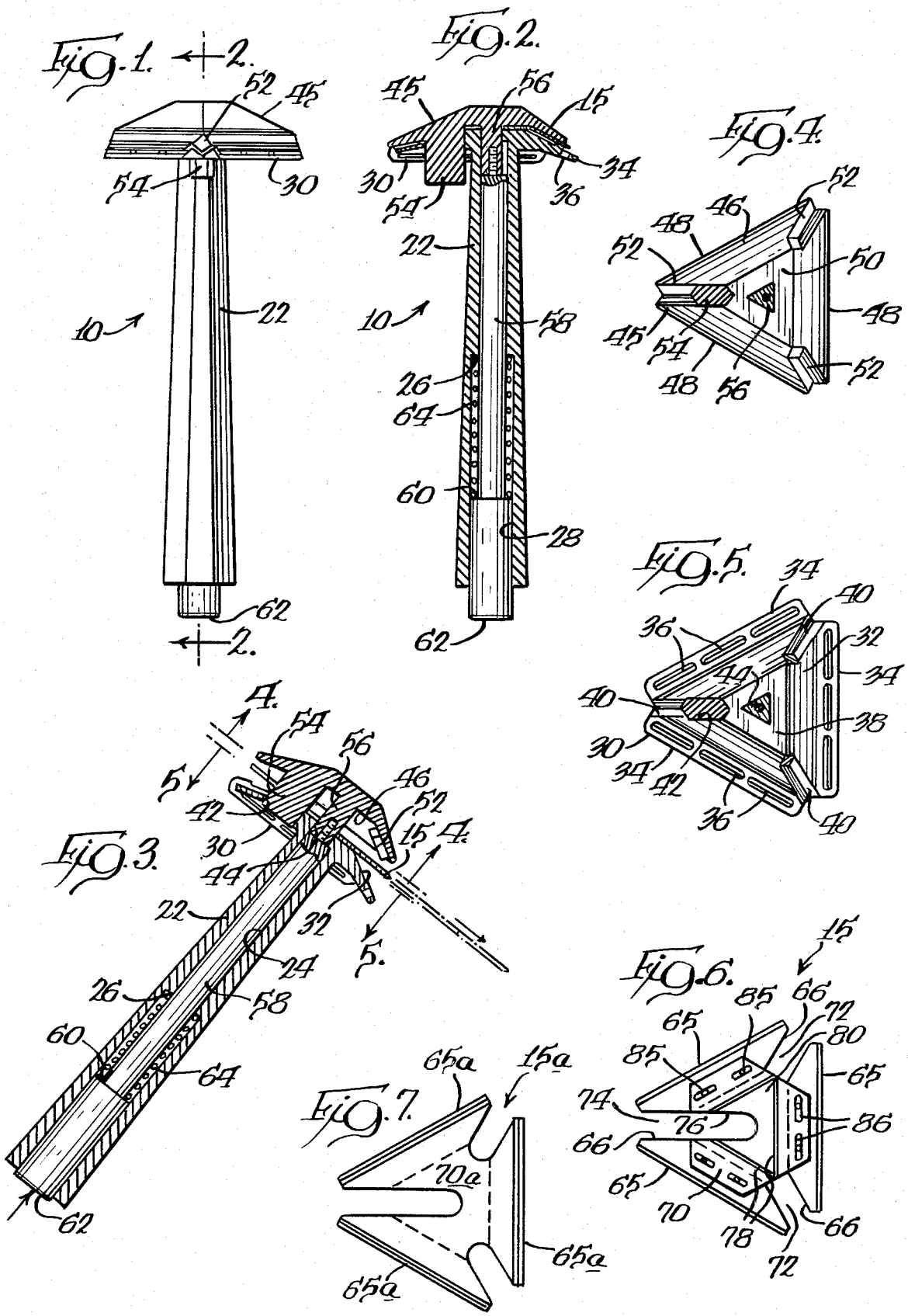
FIG. 1 is a side elevational view of a safety razor and retained blade embodying the principles of the invention.
FIG. 2 is a vertical sectional view taken on the plane of line 2—2 in FIG. 1.
FIG. 3 is a similar view but illustrating the clamping head in the raised position and the blade being removed.
FIG. 4 is a sectional view taken on the plane of line 4—4 in FIG. 3 and illustrating the bottom surface of the clamping head.
FIG. 5 is a sectional view taken on the plane of line 5—5 in FIG. 3 and illustrating the top surface of the blade supporting face.
FIG. 6 is a plan view of a three-edge blade embodying the principles of the invention.
FIG. 7 is a plan view of another form of the inventive blade.

While this invention is susceptible of embodiment in many different forms, there is shown in the drawing and will be described herein in detail specific embodiments thereof with the understanding that the present disclosure is to be considered as an exemplification of the principles of the invention and is not intended to limit the invention to the specific embodiment illustrated.

While the present invention contemplates a multiple edge blade in general, for convenience it is described below with respect to a three-edge blade. Referring with greater particularity to the various Figures of the drawings, the reference numeral 10 indicates generally a safety razor embodying the principles of the invention. A compound three-edge blade useable with the razor 10 and also embodying the principles of the invention is indicated generally at 15.

Razor 10 comprises an elongated handle 22 formed with a longitudinal bore 24 therein. The bore 24 is formed with an annular shoulder 26 providing an enlarged diameter section 28 for reasons which will become apparent. In the embodiment illustrated, the handle 22 is generally triangular in section, but the same may likewise be of any other outer configuration such as circular, if desired. For example, the shape of the handle may correspond to the shape of the blade.

A blade support 30 is carried by the handle 22 at the top thereof. As shown most clearly in FIGS. 2, 3 and 5, blade support 30 is generally triangular in plan and frusto-pyramidal in section. It will thus be seen that blade support 30 comprises a top face 32 having three blade supporting edges 34, provided with the customary flow through cleaning apertures 36, and a substantially flat central area 38. Top face 32 is also formed with a positioning hollow or receptacle 40 adjacent each of the corners thereof, a generally oval-shaped locking slot 42, and a central triangular keyhole 44, said slot and keyhole extending completely through the blade support 30.

Cooperating with the blade support 30 is a complementarily shaped clamping head 45. The inner face 46 of clamping head 45 thus comprises three gripping edges 48, a substantially flat central area 50, and a positioning boss 52 adjacent each of the corners thereof and adapted to be received in the blade support hollows 40. Depending from the clamping head face 46 is an oval-shaped locking lug 54 adapted to be slidably received in the locking slot 42 in blade support 30 and a central triangular shaft 56 adapted to be slidably received in the keyhole 44.

An operating stem or spindle 58 is connected to the shaft 56 and is slidably positioned in the bore 24 of the handle 22. The stem 58 is formed with an annular shoulder 60 to provide an enlarged diameter operating button 62 projecting from the bottom of the razor handle 22. A coil spring 64 is mounted in the bore 24 between the shoulders 26 and 60 to normally urge the clamping head 45 into the operational shaving position illustrated in FIGS. 1 and 2 of the drawings. When it is desired to raise the clamping head 45 (see FIG. 3) it is simply necessary to compress the spring 64 by pressing on the stem button 62, or the locking lug 54. Release of the button 62 or lug 54 results in automatic return of the clamping head to the operational shaving position. It will be noted that, even during the raising of the clamping head 45, the razor 10 is unified and none of its parts become separated.

Turning to FIG. 6 of the drawings, one embodiment of the novel compound blade 15 of the invention will now be described. The blade 15 comprises three individual single-edge strip blades 65. The strip blades 65 may comprise standard shaving edges approximately 1 7/16 inches long, but the lateral edges 66 thereof have been tapered back to provide the trapezoidal form illustrated. A flexible matrix or web 70 is connected to the blades 65 and retains said blades so that their adjacent tapered edges 66 are in spaced substantially parallel relationship to afford a pair of positioning notches 72 and a locking notch 74.

The web 70 is of generally hexagonal configuration, but has a notch 76 opening to one side thereof to provide the elongated locking notch 74. Locking notch 74 is adapted to slidably accommodate the locking lug 54 and the shaft 56 therein, while the positioning notches 72 are adapted to accommodate positioning bosses 52 therethrough. The web 70 is also formed with score or hinge lines 78 which define a central area 80 complementary to the central area 38 of the blade support 30. It will thus be appreciated that the blade 15 is adapted to be retained between the blade support 30 and gripping head 45 in contour accommodating relationship and under perfect tension for shaving purposes, as in FIGS. 1 and 2 of the drawings.

The web 70 may be fabricated from a variety of flexible materials, including plastics and metals, and a number of feasible assembly methods are contemplated. As illustrated in FIG. 6, for example, web 70 comprises a pre-molded plastic matrix having six bosses 85 adapted to be positioned through the holes 86 conventionally found in strip blades such as 65. The bosses 85 are then simply crimped or riveted by heat and pressure to form blade assembly. In another method of assembly, the three strip blades could be used as inserts in an injection molding die. Where the web comprises metal, the connections could be made with suitable punch or crimping dyes.

Still another structure and method of assembling a blade is illustrated in FIG. 7 of the drawings. Here it will be seen that the blade **15*a* comprises three strip blades 65*a* which are solid throughout and do not require the earlier holes 86. The web 70*a* comprises a pair of very thin layers of flexible plastic film adhered together and to the blades 65*a* and sandwiching the blades therebetween. The adherence of the two films to the blades and to each other can be readily accomplished either by heat sealing or adhesive coatings. It is important to note that in the blade 15*a***, the previously described hinge lines are no longer required. This is so because the great flexibility of the thin plastic films permits the material of construction itself to function as hinges.

Irrespective of the method of manufacture, the blade is hingedly flexible in either direction and operation of the invention is the same. To insert a blade 15 or **15*a*, the user raises the gripping head 45 by finger pressure on the button 62 or locking lug 54, positions a blade so that the locking lug and shaft 56 enters the locking notch 74 and simply releases the finger pressure. The same procedure is followed for rinsing or removal of the blade. In the case of blade removal, it will be noted that tilting of the razor 10 permits the blade to fall out of its own weight. (see FIG. 3**).

Various modifications are contemplated and may obviously be resorted to by those skilled in the art without departing from the spirit and scope of the invention, as hereinafter defined by the appended claims.

What is claimed is:

1. A blade assembly for use in a triple-edge safety razor comprising:

three individual blades; and a flexible central web interconnecting said blades in triangular relationship, said central web providing a flexible connection between said blades;

said triangular blade assembly defining an elongated aperture having an open end at a location adjacent to one apex of said triangular blade assembly and between the ends of a pair of the individual blades and extending substantially through the flexible central interconnecting web to a closed end at substantially the center of said triangular blade assembly to define an open ended notch adapted to permit sliding insertion and removal of the triangular blade assembly from a triple-edge safety razor without disassembly thereof.

2. A blade assembly according to claim 1 wherein said blades comprise metallic strip blades, and said web comprises a pair of thin layers of plastic film adhered together and to said blades and sandwiching said blades therebetween.

3. A blade assembly according to claim 2 wherein said web comprises a flexible plastic sheet, said sheet being formed with a score line parallel to the cutting edge of each of said blades to define hinged connections between said blades.

4. A blade assembly according to claim 3 wherein said metallic blades are formed with openings therethrough, said plastic sheet is formed with bosses thereon, and said plastic sheet is connected to said blades by said bosses extending through said openings.

5. A blade assembly according to claim 2 wherein said web comprises a thin metallic sheet connected to said blades.

* * * * *